US005399055A

United States Patent [19]

Dutton, Jr.

[11] Patent Number: 5,399,055

[45] Date of Patent: Mar. 21, 1995

[54] DEVICE AND METHOD TO LEVEL AND REPAIR A FAILED CONCRETE FOUNDATION

[76] Inventor: Elmer T. Dutton, Jr., 1503 Oaks Dr., Pasadena, Tex. 77502

[21] Appl. No.: 144,706

[22] Filed: Oct. 28, 1993

[51] Int. Cl.[6] ..... E02D 5/00; E02D 27/48

[52] U.S. Cl. ..... 405/230; 405/233; 405/257; 405/248

[58] Field of Search ..... 405/229, 230, 231, 233, 405/239, 248, 251, 252, 255, 257

[56] References Cited

U.S. PATENT DOCUMENTS

| | | | |
|---|---|---|---|
| 4,063,421 | 12/1977 | Coone et al. | 61/102 |
| 4,063,423 | 12/1977 | Gurkov et al. | 61/53 |
| 4,195,487 | 4/1980 | Fukushima | 405/237 |
| 4,909,673 | 3/1990 | Barthelemy | 405/231 |
| 4,917,542 | 4/1990 | Hickey | 405/241 |
| 4,974,997 | 12/1990 | Sero et al. | 405/231 |
| 4,982,549 | 1/1991 | Beck | 52/746 |
| 5,004,375 | 4/1991 | Lee | 405/230 |
| 5,096,333 | 3/1993 | Bassett | 405/244 |
| 5,116,355 | 5/1992 | Freeman, III | 405/230 |
| 5,123,209 | 6/1992 | Nally | 52/165 |
| 5,217,325 | 6/1993 | Freeman, III | 405/229 |
| 5,228,806 | 7/1993 | DeMedieros | 405/231 |
| 5,228,807 | 7/1993 | Wilcox | 405/232 |
| 5,234,287 | 8/1993 | Rippe, Jr. | 405/230 |
| 5,246,311 | 9/1993 | West | 405/230 |

*Primary Examiner*—David H. Corbin
*Attorney, Agent, or Firm*—Derek R. Van Gilder

[57] ABSTRACT

A means of leveling and repairing an existing concrete foundation that has failed due to differential settlement, subsidence, soil shifting, surface faults or trees. A series of cylindrical pile segments are jacked into the soil while water jetting to a predetermined depth wherein sufficient skin friction is attained. Reinforcing steel is inserted into the stacked column of cylindrical pile segments and grout is further pumped into the cylindrical pile segments to suitably fix the reinforcing steel to the inside of the cylindrical pile segments, forming a single shaft pile further eliminating or reducing pile deflection and shear.

15 Claims, 10 Drawing Sheets

DEVICE AND METHOD TO LEVEL AND REPAIR A FAILED CONCRETE FOUNDATION

There are many methods of inserting and driving piles into soil such as sand, clay, gravel, dirt, etc. Some of these methods and designs are GURKOV et al U.S. Pat. No. 4,063,423, FUKUSHIMA U.S. Pat. No. 4,195,487, BARTHELEMY et al U.S. Pat. No. 4,909,673, HICKEY U.S. Pat. No. 4,917,542 and BECK U.S. Pat. No. 4,982,549, BASSETT U.S. Pat. 5,096,333, FREEMAN, III U.S. Pat. Nos. 5,116,355 and 5,217,325, NALLY U.S Pat. No. 5,123,209, DE MEDIEROS, JR. U.S. Pat. No. 5,228,806, WILCOX, JR. U.S. Pat. No. 5,228,807, WEST U.S. Pat. No. 5,246,311, RIPPE, JR., U.S. Pat. No. 5,234,287.

Although all of the above designs and inventions are good and useful, they are not developed to allow a pile to be placed or set below an existing foundation that has failed or is in danger of failure which in turn causes additional structural and cosmetic damage to the building or structure.

SUMMARY OF THE INVENTION

It is the object of the present invention to provide a pile that can be set below an existing foundation or structure without the labor intensive and time consuming chore of drilling or digging a hole to the predetermined depth of the pile and then filling the hole with concrete to form a pile.

Another object of the present invention is to eliminate the cost and unpredictability of soil testing to determine the size and depth required of a pile to support a given building or structure foundation that has failed or in danger of failing.

Another object of the present invention is to be able to speed up the driving of the pile sections with the jetting system through soil conditions that would otherwise be impractical and time consuming.

Another object of the present invention is to provide a concrete pile that is cured off site at a concrete plant, transported to the foundation repair location and further set to the required compression and soil refusal at the necessary depth, without having to wait for days or weeks for the concrete to cure for strength at the site of the foundation repair.

Still another object of the present invention is to have a concrete pile set in small units or sections that can be easily lifted by hand and moved in small and light segments and yet provide the required horizontal shear resistant strength to further reduce any possible deflection in the pile due to shifts in the soil.

Another object of the present invention is to eliminate the cost and unpredictability of soil testing to determine the size and depth required of a pile to support a given building or structure foundation that has failed or is in danger of failing.

Another object of the present invention is to be able to speed up the driving of the pile sections with the jetting system through soil conditions that would otherwise be impractical and time consuming.

The features of the present invention can best be understood together with further objects and advantages by reference to the following descriptions taken in conjunction with the accompanying drawings wherein like numerals indicate like parts.

DETAILED DESCRIPTION OF THE PREFERRED EMBODIMENT

Figure 1:
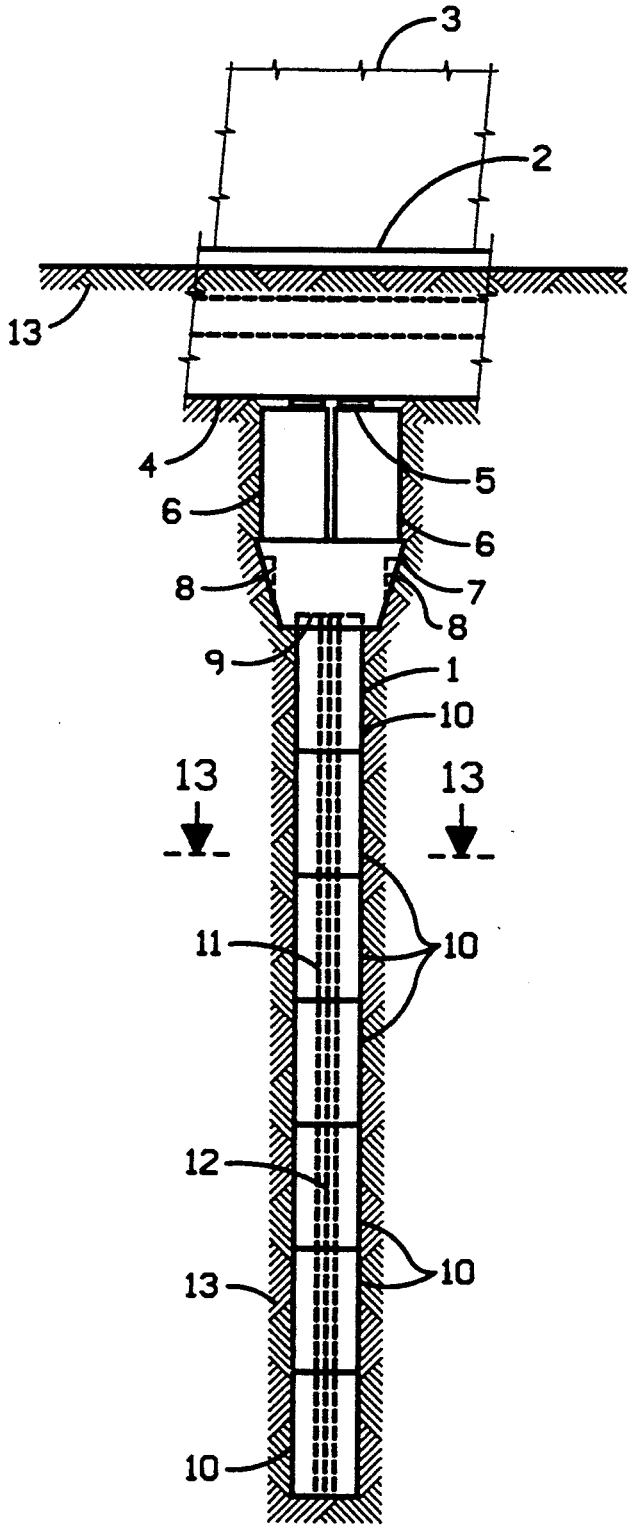
FIG. 1 is a frontal elevation of the completed pile supporting an existing foundation.

Referring to FIG. 1 there is shown an elevation view of a pile 1 after it has been completed. The pile 1 is shown supporting an existing foundation 2 or an existing structure.

The existing foundation 2 as shown is composed of a wall 3 that is supported by a grade beam 4. The existing foundation 2 shown is made of concrete, but could also be constructed out of steel or treated wood by design choice.

The existing foundation 2 is shown being supported by shims. Although the shims are made out of steel, they could also be made out of wood, plastic, brass or other suitable material by design choice. There is shown at least one shim with a top side bearing on the bottom side of the existing foundation 2 or grade beam 4 and the bottom side bearing on the upper end of at least one shim stanchion 6. There are two shim stanchions 6 showing bearing on a pile cap 7. The shim stanchions 6 have an upper end and a lower end and are round or rectangular in section by design choice and are made of a suitable material such as concrete or metal by design choice.

The pile cap 7 is shown as a trapezoid in configuration with a top end and a bottom end. The top end of the pile cap 7 has a greater suface area than the bottom end. The top end is shown to have a suitable surface area to support at least one shim stanchion 6, but most likely two or more shim stanchions 6. The pile cap 7 transfers the load of the shim stanchions 6 into the pile 1. The pile cap 7 is further shown with a first side, a second side, a third side and a fourth side. A hand hold notch 8 is shown formed in the first side and the third side of the pile cap 7 and a pile notch 9 is shown formed in the bottom end of the pile cap 7. The pile notch 9 is of a suitable surface area to receive and support the pile 1.

The pile 1 is shown with an upper end and a lower end and is comprised of numerous pile segments 10 determined by the conditions present with the soil and structure or building. The pile 1 has an inner hole 11 that is filled with grout 44 and a reinforcing rod or cable 12, determined by design choice. The means of placing the reinforcing rod 12 and the grout into the cavity will be explained later. When the upper end of the pile 1 is in the pile notch 9, the pile 1 is secured from moving laterally in reference to the pile cap 7.

The pile 1, the grade beam 4, and the pile cap 7 are shown encased in soil 13. When the pile is being set in place, the soil 13 will be removed near the upper end of the pile 1 but very little or no soil 13 will be removed near the lower end of the pile 1.

Figure 2:
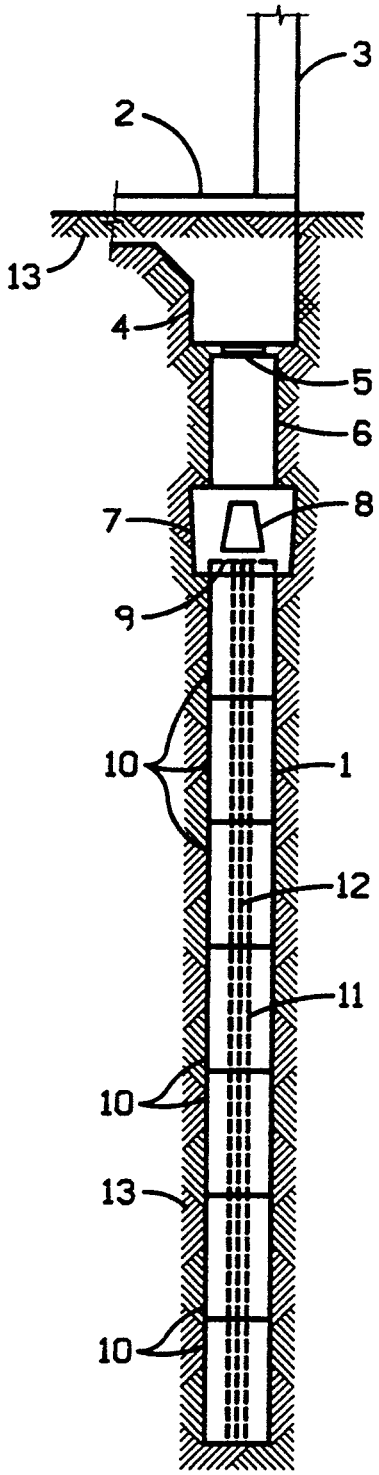
FIG. 2 is a side elevation of FIG. 1 showing the completed pile supporting an existing foundation.

Referring to FIG. 2 there is shown a side elevation of the pile 1.

The pile 1 is shown supporting the existing foundation 2 and the grade beam 4. The wall 3 is shown suitably fixed to the existing foundation 2.

The shims 5 are shown between the grade beam 4 and the shim stanchion 6. The pile cap 7 is shown suitably held between the shim stanchion 6 and the pile 1. A hand hold notch 8 is shown formed in the pile cap 7. The pile 1 is also shown inserted in the pile notch 9.

The pile 1 is shown comprised of the pile segments 10 suitably fixed to each other by the combination of the reinforcing rod 12 and grout suitably located in the inner cavity 11. The pile 1 is shown suitably supported in the soil by skin friction or compression or other suitable means.

Figure 3:
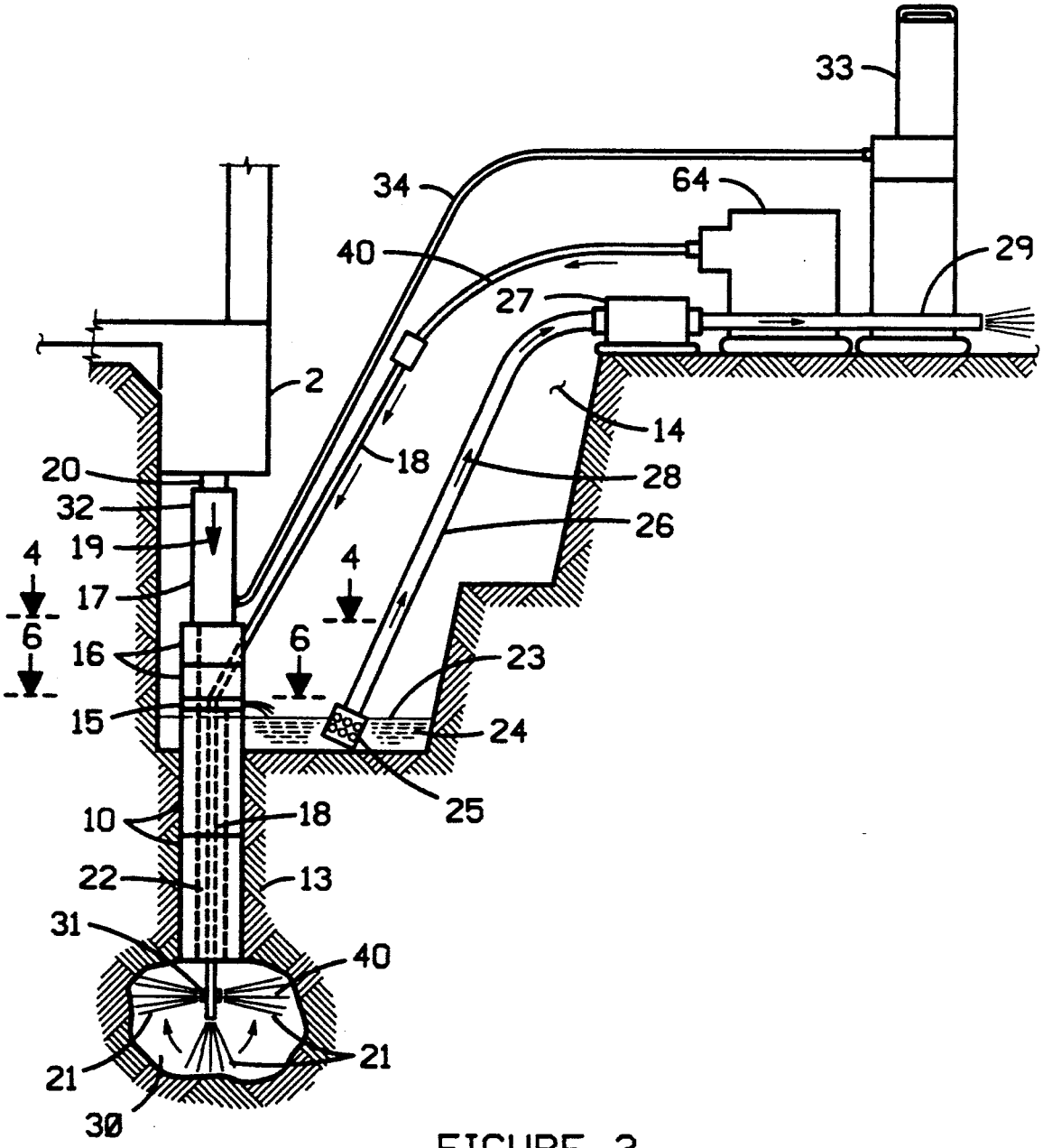
FIG. 3 is a side elevation of the pile being thrust into the soil.

Referring to FIG. 3 there is shown an elevation view of the method used to insert the pile segments 10 into the soil 13 that will form the pile 1 below the existing foundation 2.

An excavation 14 is formed below the existing foundation 2 allowing for the installation of the pile segments 10, a slotted driving plate 15, slotted spacers 16 and a pile jack 17. The slotted driving plate 15 is made of steel or other suitable material of design choice. The slotted spacers 16 are made of aluminum or other light weight material of design choice.

The pile jack 17 is shown to be a hydraulicly activated device, however, it could be a geared or an electromotive device by design choice. The pile jack 17 utilizes the existing foundation 2 as a ballast or counterweight to jack or thrust the pile segments 10 into the soil 13.

The slotted spacers 16 and the slotted driving plate 15 are slotted to allow for the insertion of the fluid jetting conduit 18 and later a grouting conduit and vacuum tube. The slotted driving plate 15 and the slotted spacers 16 are further detailed and explained in FIGS. 4, 5, 6 and 7. The slotted driving plate 15 is required to allow the pile jack 17 to exert a downward force 19 on the pile 1 and further to spread the load equally on the upper end of the upper most pile segment 10. The slotted spacers 16 are employed when the pile jack 17 extends to its greatest length as it thrusts the pile segments 10 into the soil 13. When the pile jack 17 has thrust the pile segments 10 into the soil to its greatest length, a jack ram 20 is then forced back into jack cylinder 21 and another slotted spacer 16 is placed below the pile jack 17 and again the pile jack 17 is actuated, exerting the downward force 19 into the slotted spacers 16, the slotted driving plate 15 and into the pile segments 10 further forcing the pile segments 10 into the soil 13.

As the pile segments 10 are being forced into the soil 13, a fluid jet 21 is jetting fluid 40 such as water or some other suitable material into the soil 13 further loosening and removing the soil 13 and forcing the soil 13 up through a soil fluid annulus 22 of the pile segments 10 and into a soil fluid reservoir 23 below the uppermost pile segment 10, thus allowing the lowermost pile segment 10 to be easily lowered or thrust further into the soil 13. As the soil suspended in fluid 24 is forced out of the soil fluid annulus 22, it is forced out of the slotted driving plate 15 and into the soil fluid reservoir 23 where it is further sucked out of the soil fluid reservoir 23 through a suction head 25, into a suction hose 26, and upward 28 through a suction pump 27 and through a soil fluid-discharge conduit 29 and into a settling tank not shown, where the soil settles to the bottom of the tank and can later used for fill soil.

The fluid 40 is pumped from a fluid pump 64 through the jetting conduit 18 and out a fluid jetting nozzle 31 where it jets out a cavity 30 forming a cannular path for the pile segments 10 to follow in the soil 13 below the lowermost end of the lowermost pile segment 10.

The pile jack 17 is comprised of a hydraulic cylinder 32 and the jack ram 20 and is actuated by hydraulic fluid under pressure from a hydraulic pump 33 through a hydraulic line 34 and into the hydraulic cylinder 32 where it reacts with a hydraulic piston not shown, thus forcing the jack ram 20 out of the hydraulic cylinder 32 and further reacting with the existing foundation 2, thrusting with the downward force 19 on the pile segments 10.

Figure 4:
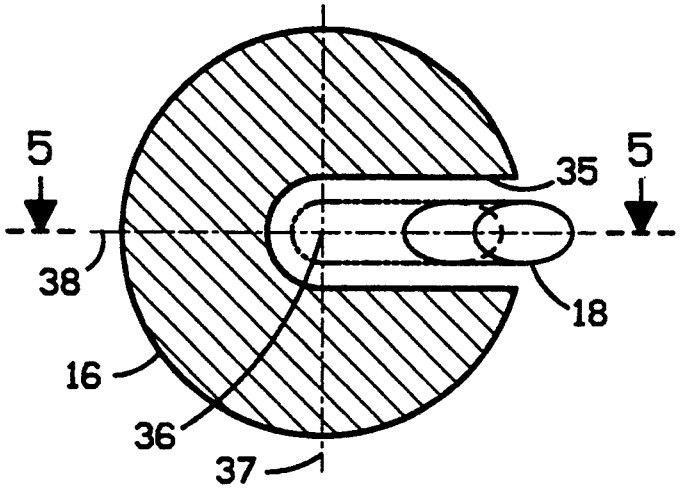
FIG. 4 is a section view of the slotted spacer plate as taken through FIG. 3.

Referring to FIG. 4 there is shown a section view of the slotted spacer 16 as taken through FIG. 3.

The jetting conduit 18 is shown sloping through a spacer slot 35 formed in the slotted spacer 16. The center axis 36 is shown with a first center conduit 37 and a second center conduit 38.

Figure 5:
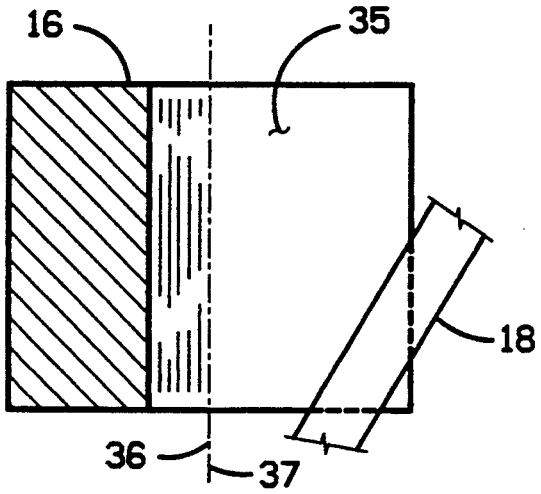
FIG. 5 is a section elevation as taken through FIG. 4.

Referring to FIG. 5 there is shown an enlarged section elevation of the slotted spacer 16 as taken through FIG. 4.

The jetting conduit 18 is shown sloping in the spacer slot 35. The first center line 37 shown is the center of the slotted spacer 16 forming the center axis 36.

Figure 6:
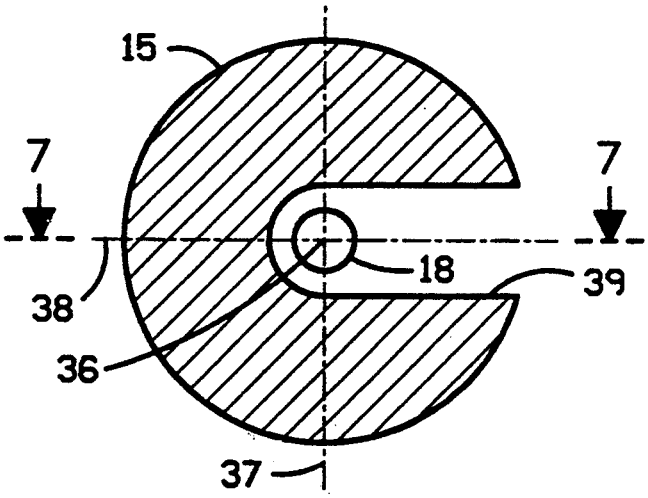
FIG. 6 is a section view of the slotted driving plate as taken through FIG. 3.

Referring to FIG. 6 there is shown a section view of the slotted driving plate 15 as taken through FIG. 3. The jetting conduit 18 is shown near the center of the center axis 36 and further near the center of a driving plate slot 39.

The center axis 36 is comprised of the first center line 37 and the second center line 38.

Figure 7:
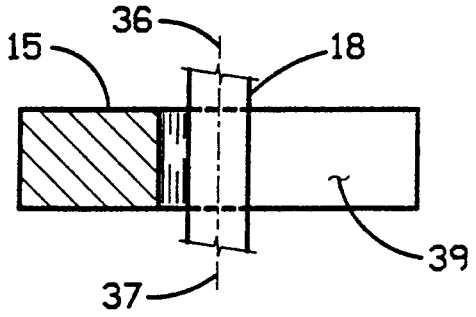
FIG. 7 is a section elevation as taken through FIG. 6.

Referring to FIG. 7 there is shown a section elevation of the slotted driving plate 15 with the jetting conduit 18 located near the center axis 36.

The first center line 37 forms the center axis 36. The driving plate slot 39 is shown formed in the slotted driving plate 15.

Figure 8:
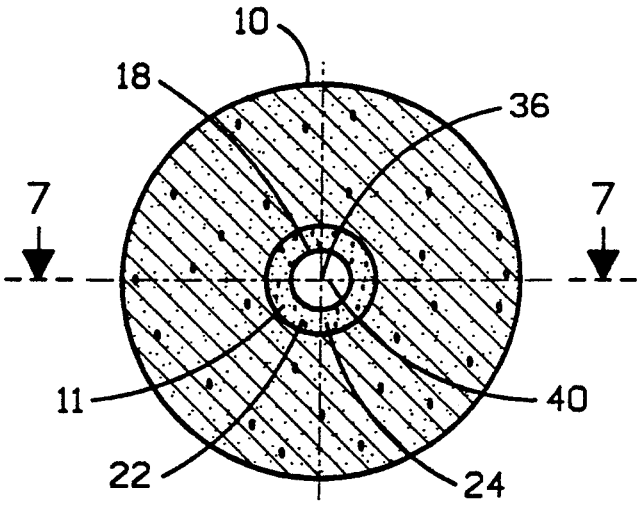
FIG. 8 is a section view of the pile cylinder as taken through FIG. 3.

Referring to FIG. 8 there is shown a section view as taken through the pile segment 10 of FIG. 3.

The jetting conduit 18 is shown near the center axis 36 of the pile segment 10. The jetting conduit 18 is also located in the inner hole 11 of the pile segment 10 forming the soil fluid annulus 22 between the inner surface of the pile segment 10 and the outer surface of the jetting conduit 18.

The fluid 40 is pumped through the jetting conduit 18 and further soil suspended in the fluid 24 is pumped out in the soil fluid annulus 22.

Figure 9:
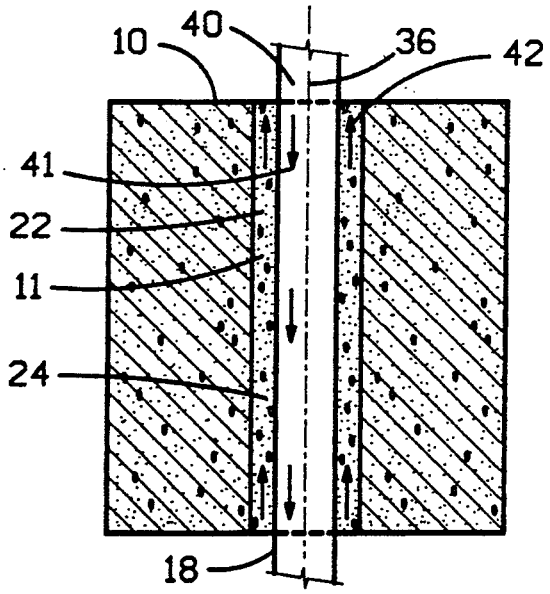
FIG. 9 is a section elevation as taken through FIG. 8.

Referring to FIG. 9 there is shown a section elevation of the pile segment 10 as taken through FIG. 8.

The fluid 40 is shown moving in a downward direction 41 through the jetting conduit 18. Soil suspended in the fluid 24 is shown moving in an upward direction 42 through the soil fluid annulus 22 formed between the inner hole 11 of the pile segment 10 and the outer surface of the jetting conduit 18. The jetting conduit 18 is also shown near the center axis 36 of the pile segment 10.

Figure 10:
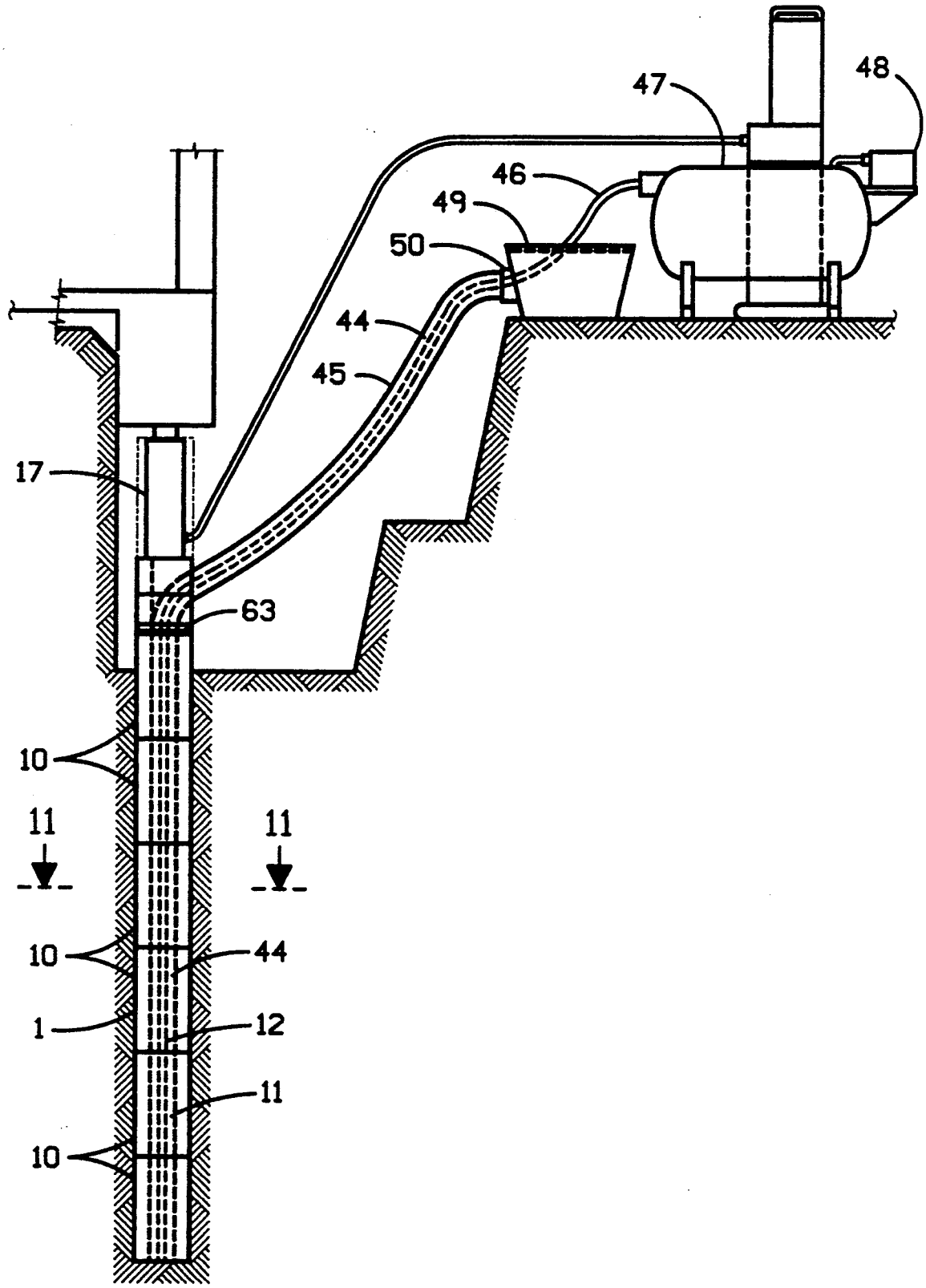
FIG. 10 is an elevation view showing the pile being grouted.

Referring to FIG. 10 there is shown an elevation view of the pile segments 10 being suitably fixed to each other with the reinforcing rod 12 and the grout 44 to become a single pile.

The pile segments 10 have been jetted and jacked into place or to a suitable depth to obtain the required skin friction whereby no more pile segments 10 can be driven into the soil 13 without lifting the grade beam and the existing foundation. This is called the point of refusal. The jetting line has been withdrawn.

The reinforcing rod 12 made of steel, plastic, resin or some other suitable material is inserted into the inner hole 11 formed in the pile segments 10. The second end of a grouting hose 45 is inserted through the slot in the slotted driving plate 15 and the slot of the slotted spacer 16 where it is suitably fixed near the upper end of the first pile segment 10 with a grouting hose gasket 63. The first end of the grouting hose 45 is suitably fixed to a hose fitting 50 on a grouting tub 49. The second end of a vacuum tube 46 is inserted through the grouting tub 49 through the grouting hose 45, through the lowermost end of the inner hole 11. The grouting tub 49 is filled with grout 44 or other suitable material in a liquid form. A vacuum pump 48 is actuated, forming a vacuum in a vacuum tank 47 and further forming a vacuum in the vacuum tube 46 which in turn draws all liquid into the vacuum tube 46 and the vacuum tank 47 further evacuating the inner hole 11 of any liquid and further draws the grout 44 into the inner hole 11 of the pile segments 10. When the inner hole 11 of all of the pile segments 10 is filled near the uppermost end of the uppermost pile segment 10, the grouting hose 45 is removed and the vacuum robe 46 is withdrawn from the inner hole 11.

The grout 44 is allowed to cure for a suitable time and the pile segments 10 become one monolithic pile 1. After the grout 44 has sufficiently cured, the pile jack 17 is again actuated to push down on the pile 1 to determine if the pile has developed sufficient skin friction. The pile 1 is tested by compression of the pile jack 17 to determine if the pile 1 has suitable skin friction.

Figure 10A:
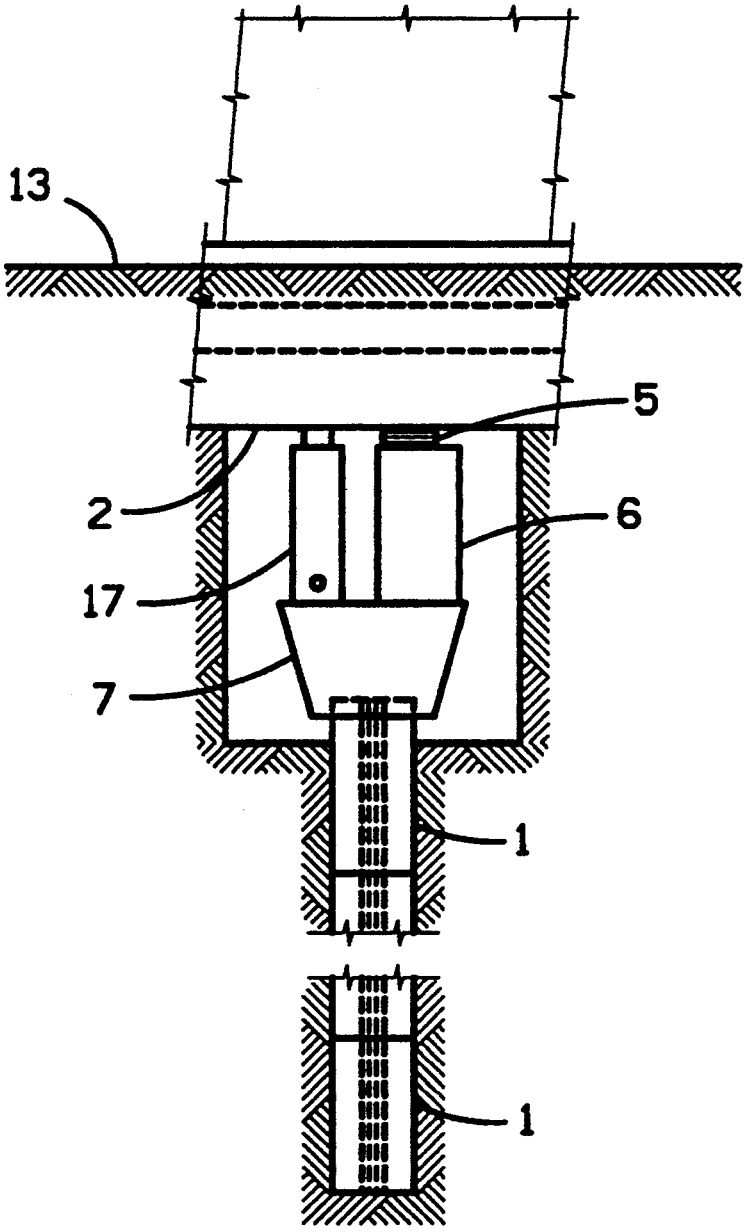
FIG. 10A is an elevation view of the pile cap and means of placing the shim stanchion and shims below the existing foundation.

Referring to FIG. 10*a* there is shown a frontal elevation of the pile 1 with the pile cap 7 suitably placed on the uppermost end of the pile 1. The pile jack 17 is shown on one side of the pile cap 7 and a shim stanchion 6 with shims 5 are shown on the other side of the pile cap 7.

The pile jack 17 is suitably actuated and it further elevates the foundation 2 to the desired height relative to the soil 13. When the desired height of the foundation 2 is accomplished, the shim stanchion 6 and the required number of shims 5 are inserted between the pile cap 7 and the foundation 2. The pile jack 17 is removed and a second shim stanchion and additional shims are set in place as shown in FIG. 1. The combination of the pile 1, the pile cap 7, the shim stanchions 6 and the shims 5 forms a monolithic column-like pile.

Figure 11:
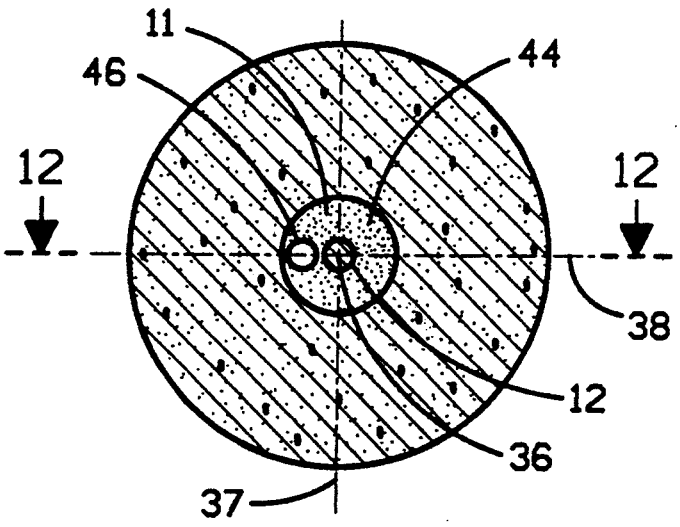
FIG. 11 is a section view of the pile as taken through FIG. 10.

Referring to FIG. 11 there is shown a section view as taken through FIG. 10 showing the pile segment 10 with the reinforcing rod 12 located near the center axis 36 of the pile segment 10. The center axis 36 is the point where the first center line 37 intersects the second center line 38.

The inner hole 11 is shown filled with grout 44. The vacuum tube 46 is shown near the center axis 36.

Figure 12:
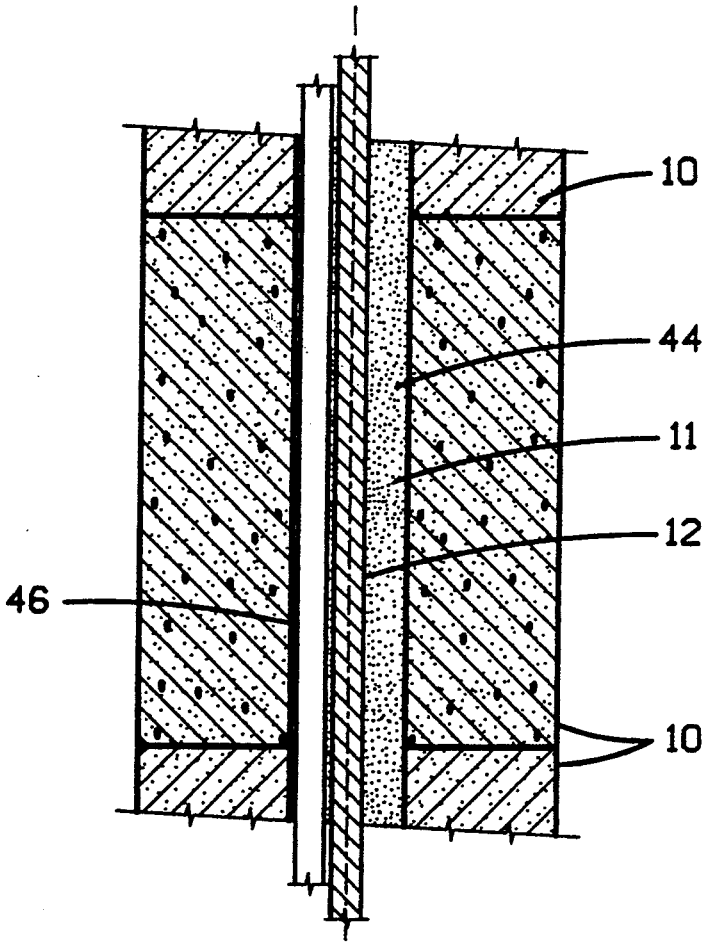
FIG. 12 is a section elevation view as taken through FIG. 11.

Referring to FIG. 12 there is shown a section elevation as taken through FIG. 11.

The inner hole 11 of the pile segments 10 is shown with grout 44. The vacuum tube 46 is shown in the inner hole 11 near the reinforcing rod 12.

Figure 13:
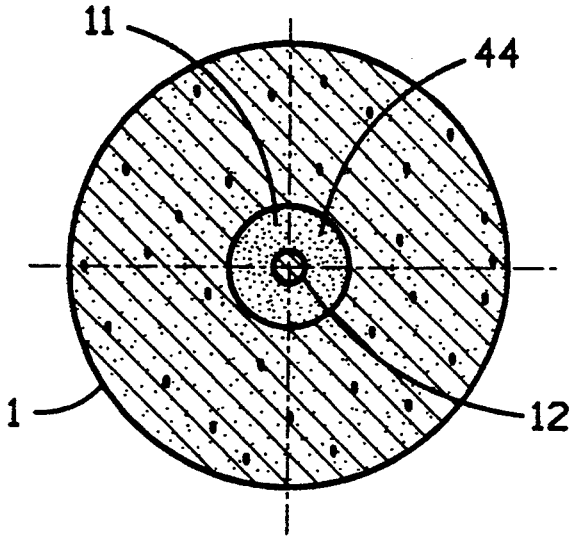
FIG. 13 is a section view as taken through FIG. 1.

Referring to FIG. 13 there is shown a section view as taken through FIG. 1.

The grout 44 has cured around the reinforcing rod 12 and on the inside surface of the inner hole 11 forming the single pile 1 from the pile segments 10.

Figure 14:
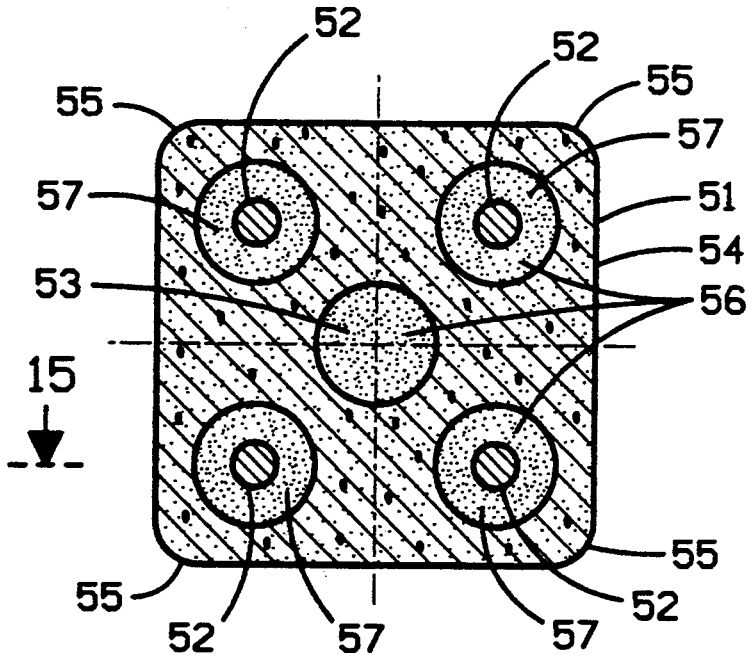
FIG. 14 is a section view of a square pile of another preferred embodiment.

Referring to FIG. 14 there is shown a section view of a pile 51 of the second preferred embodiment of the invention.

The configuration of the pile 51 is square or rectangular by design choice with reinforcing rods 52 near each corner of the pile 51 which will give the pile 51 greater strength in bending due to a possible soil shift or a possible grade beam shift.

There is a center inner hole 53 in the center of the pile for placing a jetting line to jet out the soil below the pile 51 while the pile segments 54 are being driven and set in place; this is similar to the pile 1 of the first preferred embodiment. After the pile segments 54 are set in place the center inner hole 53 is suitably filled with grout 56 in the same manner as the pile 1 of the first preferred embodiment.

The four reinforcing rods 52 and the grout 56 shown in the corner inner cavities 57 near four corners 55 of the pile segment 54 are set in a similar manner as with the first pile 1 of the first preferred embodiment.

Figure 15:
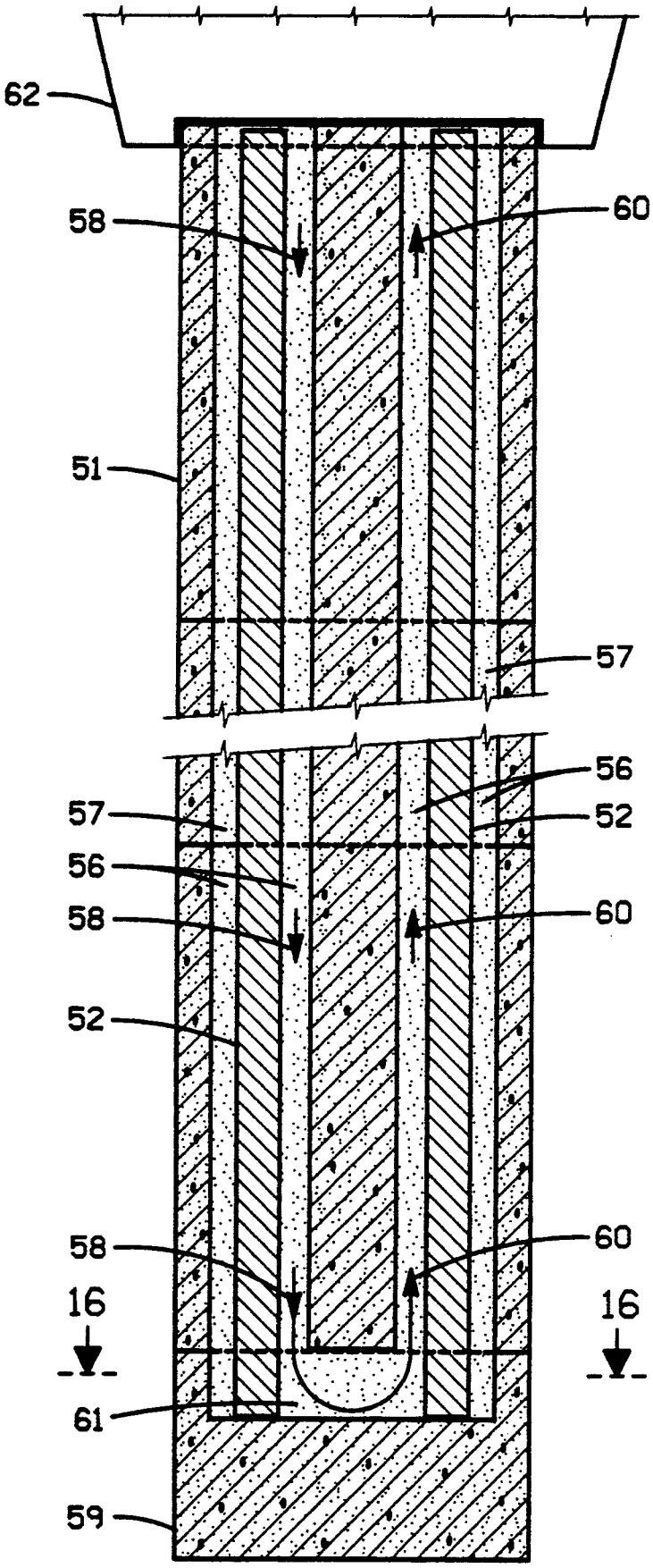
FIG. 15 is a section elevation as taken through FIG. 14.

Referring to FIG. 15 there is shown a section elevation of the pile 51 of the second preferred embodiment of the invention as taken through FIG. 14.

There are two corner inner holes 57 shown with the reinforcing rod 52 shown in each corner inner hole 57. Grout channels 61 are shown formed in the upper end of a grout redirection pile segment 59 and extend toward the lower end of the grout redirection pile segment 59. The grout 56 under pressure is injected into the first corner inner hole 57 in a downward direction 58 until the grout 56 reaches the grout channels 61 formed in the grout redirection pile segment 59 that is on the lowermost end of the pile 51 wherein the grout is forced to move in an upward direction 60 until it reaches the upper end of the uppermost pile segment and either flows out of the second corner inner hole 57 or the grout flow is shut off. When the grout 56 cures in the inside of the corner inner cavities 57 around the reinforcing rods 52, the pile segments 54 become the monolithic pile 51. This same process is accomplished with the other two corner inner cavities 57.

Figure 16:
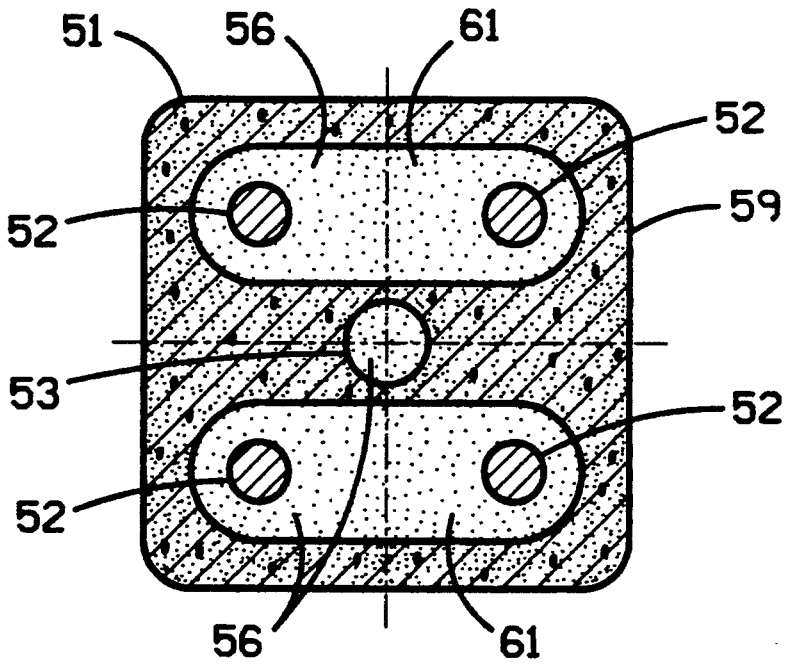
FIG. 16 is a section view as taken through FIG. 15.

Referring to FIG. 16 there is shown a section view of the grout redirection pile segment 59 as taken through FIG. 15.

There are two grout channels 61 shown and formed in the grout redirection pile segment 59 and there is also a center inner cavity 53 shown for jetting soil out of the way as each pile segment 51 being driven or thrust into the soil.

The two grout channels 61 are of sufficient size to allow the grout 56 to flow from the first corner inner hole to the second corner inner hole. The lowermost ends of the reinforcing rods 52 are shown near the first end and the second end of the grout channels 61.

As shown in FIG. 15 a pile cap 62 is disposed on the upper end of the pile 51. The pile cap 62 and all other items above the uppermost end of the pile 51 are similar to the pile of the first preferred embodiment of FIG. 1.

Although the system described in detail supra has been found to be most satisfactory and preferred, many variations are possible. For example, the pile could be made in a triangular configuration in section with a reinforcing rod near each angle of the triangle, a fifth reinforcing rod could be included in the center of the pile of the second preferred embodiment, the round pile in section could have more than one reinforcing rod or the jetting lines could be used to jet grout into the pile.

Although the invention has been described with reference to the preferred embodiments, it will be understood by those skilled in the art that additional modifications, substitutions, deletions and other changes not specifically described, may be made in the embodiments contained herein. It should be understood that the details herein are to be interpreted as illustrative and are not in a limiting sense.

What is claimed as invention is:

1. A pile inserted into soil below an existing structure in segments and parts comprising:

at least one pile segment with an upper end and a lower end and a center axis that extends from said upper end to said lower end of said pile segment and wherein said pile segment has at least one inner hole that further extends from said upper end to said lower end of said pile segment;

at least one reinforcing rod having an upper end and a lower end wherein said reinforcing rod is suitably inserted into said inner hole of said pile segment;

grout material wherein said grout material is placed into said inner hole with said reinforcing rod further fixing said reinforcing rod to said inner hole formed in said pile segment;

a pile cap with an upper end and a lower end wherein said pile cap has a pile notch formed in the lower end of said pile cap and said upper end of said pile segment is disposed within said pile notch;

at least one shim stanchion with an upper end and a lower end and wherein said lower end of said shim stanchion is disposed on said upper end of said pile cap;

at least one shim with an upper side and a lower side wherein said lower side of said shim is disposed on the upper end of said shim stanchion, wherein at least one or more pile segments are inserted into said soil below a structure and wherein said reinforcing rod is inserted into said inner hole of said pile segments, and said pile segments are inserted into said soil wherein the said center axis of each pile segment is in alignment with the other pile segment center axis, and wherein said grout in a liquid form is injected into said inner hole around said reinforcing rod and wherein said grout is allowed to cure and harden forming a monolithic like pile that develops suitable skin friction between said pile and said soil and wherein said monolithic pile further suitably resists bending, deflection, and shear, and wherein said pile notch on said lower end of said pile cap is disposed over said upper end of said pile and wherein at least one said shim stanchion is placed on said upper end of said pile cap and wherein at least one shim is placed between said shim stanchion and said existing structure allowing the combination of the shims, the shim stanchions, the pile cap and the pile to form a single column that will further support said existing structure.

2. The pile of claim 1 wherein said pile segments are placed one on the other and further thrust into the soil with a jack.

3. The pile of claim 1 wherein said reinforcing rod is made out of fiber glass.

4. The pile of claim 1 wherein said reinforcing rod is made out of steel.

5. The pile of claim 1 wherein said reinforcing rod is a steel cable.

6. The pile of claim 1 wherein said grout is made out of a resin and said grout also acts as a reinforcing rod.

7. The pile of claim 1 wherein said shim is made out of a ceramic material.

8. The pile of claim 1 wherein said shim is made out of steel.

9. A means of inserting a pile in segments and parts into the soil below an existing structure comprising:

at least one pile segment with an upper end and a lower end and a center axis that extends from said upper end to said lower end of said pile segment and wherein said pile segment has at least one inner cavity that further extends from said upper end to said lower end of said pile segment;

at least one reinforcing rod having an upper end and a lower end;

grout material wherein said grout material is a liquid and later cures to a solid material;

at least one pile cap with an upper end and a lower end wherein said pile cap is wider at the said upper end than the said lower end and said pile cap further has a pile notch formed in the lower end said pile notch is slightly greater in section that said upper end of said pile segment and said pile segment may be disposed within said pile notch;

at least one shim stanchion with an upper end and a lower end and wherein said lower end of said shim stanchion is disposed on said upper end of said pile cap;

at least one shim with an upper side and a lower side wherein said lower side of said shim will rest on said upper end of said shim stanchion and said upper side of said shim will be disposed below said existing structure;

at least one liquid jetting means comprising of a pump, a jetting line, a jetting nozzle and suitable liquid;

a jacking means comprised of a hydraulic pump, a hydraulic line and a hydraulic jack;

a vacuum suction means comprised of a vacuum tube and a vacuum tank with a partial vacuum contained within said vacuum tank;

a grouting means comprised of grout tub, a grouting hose and grout hose seal;

slotted spacers with the same or greater sectional area of said pile segments and with at least one slot wider than said grouting hose, wherein said soil is excavated in the area wherein pile is to be placed, and wherein at least one said pile segment is placed into said excavation below said existing structure and wherein said slotted spacer is placed over said pile segment and wherein said hydraulic jacking means is disposed between said pile segment and said existing structure and wherein said hydraulic jacking means is actuated and further thrust down on said pile segment thereby thrusting said pile segment into said soil wherein said jetting nozzle with said jetting line is inserted through said slot formed in said slotted spacer and said jetting nozzle is further disposed in said inner cavity formed in said pile segments to where said jetting nozzle is near said soil near said lower end of said pile segment and wherein said jetting pump is actuated and forces liquid into said jetting line and said jetting nozzle and said liquid removes said soil below said pile segment forming a cannular path for said pile segments to follow as said jacking means is thrusting on said pile segments wherein when said pile segments are disposed within the soil to a suitable depth, the said jetting nozzle and jetting line are withdrawn, the jacking means is withdrawn and said reinforcing rod is inserted into said inner cavity formed in said pile segment and further said vacuum tube of said vacuum suction means is located near said lower end of the lowermost pile segment and further said grouting hose of said grouting means is further inserted into said slot formed in said slotted spacer and said grout hose seal is further placed between said slotted spacer end and said upper end of the upper most pile segment forming a suitable seal between said grouting hose and inner cavity of said pile segment wherein said grout is placed in said grout tub and said vacuum means is actuated further evacuating all liquid and other material from said inner cavity and further drawing said grout from said grout tub and grouting hose into said inner cavity until said inner cavity becomes filled with grout wherein said grout hose and said vacuum tube are withdrawn from said inner cavity and wherein said grout cures and forms a monolithic pile combining said pile segments and said reinforcing rod and wherein said pile cap is placed on said upper end of said pile with said pile suitably disposed within said pile notch formed in said lower end of said pile cap and wherein said jacking means is placed on one side of pile cap and below said existing structure wherein said jacking means is actuated and further elevates said existing structure to the desired elevation wherein one said shim stanchion is placed on the other side of said pile cap and said shims are placed between said existing structure and said shim stanchion, forming a tight fit between said shim and said existing structure wherein said jacking means is lowered and removed thus causing said existing structure to be borne by said shims, said shim stanchion, said pile cap and said pile and wherein a second shim stanchion is placed on said pile cap where said jacking means was removed from and more said shims are placed between said existing structure and said shim stanchion thereby forming a complete support below an existing structure.

10. The means of inserting a pile of claim 9 wherein said jacking means is a mechanical jack.

11. The means of inserting a pile claim 9 wherein said fluid jetted out of said jetting nozzle further flows through said inner cavity and flows out of said inner cavity through said slotted spacer wherein said fluid further flows into said excavation wherein said fluid is further pumped out of said excavation.

12. The means of inserting a pile of claim 9 wherein said vacuum tank has a vacuum pump to form a vacuum in said vacuum tank.

13. A pile inserted into the soil below an existing structure comprised off at least one pile segment, said pile segment having an upper end and a lower end wherein said pile segment is rectangular in section and wherein said pile segment has at least a first inner cavity and at least a second inner cavity wherein said first inner cavity is a preferred distance from said second inner cavity and wherein said first inner cavity and said second inner cavity are formed in said pile segment extending from said upper end through said lower end wherein said pile segment is placed into said soil and wherein at least one other pile segment is placed on top of said first pile segment;

at least one grout redirection pile segment wherein said grout redirection pile segment has an upper end and a lower end wherein a grout channel is formed in said upper end and extends near said lower end of said grout redirection pile segment and said grout channel is elongated to conform to the preferred distance from said first inner cavity to said second inner cavity of said pile segment and wherein said grout redirection pile segment is placed below said first pile segment;

grout material wherein said grout material is in a liquid form and later will cure to a solid material wherein said grout redirection pile segment is placed into the said soil and further said lower end of a said pile segment is placed on said upper end of said grout redirection pile segment wherein said first inner cavity of said pile segment is located over said grout channel formed in said grout redirection pile segment and said second inner cavity of said pile segment is also placed over said grout channel formed in said grout redirection pile segment thereby allowing said grout in said liquid form to be suitably inserted into said first inner cavity and further flow into said grout channel formed in said grout redirection pile segment wherein said grout further flows into said second inner cavity thus filling both said first inner cavity and said second inner cavity and said grout channel with grout wherein said grout cures to a solid material thus bonding said pile segments and said grout redirection pile segment into a single pile.

14. The pile of claim 1 wherein a reinforcing rod made of a suitable material is inserted into said first inner cavity and said second inner cavity,

15. The pile of claim 1 wherein a pile cap is suitably placed on said upper end of said pile segment.

* * * * *